United States Patent [19]

Astle

[11] Patent Number: 4,466,193

[45] Date of Patent: Aug. 21, 1984

[54] PRECISION SCRIBER FOR TUBULAR WORKPIECES

[75] Inventor: William H. Astle, Rancho Cordova, Calif.

[73] Assignee: Tri Tool, Inc., Rancho Cordova, Calif.

[21] Appl. No.: 435,257

[22] Filed: Oct. 19, 1982

[51] Int. Cl.[3] ..... B43L 13/10

[52] U.S. Cl. ..... 33/21 R

[58] Field of Search ..... 33/21 R, 21 C

[56] References Cited

U.S. PATENT DOCUMENTS

| | | | |
|---|---|---|---|
| 2,009,671 | 7/1935 | Mueller et al. | 33/21 R |
| 2,582,078 | 1/1952 | Solum et al. | 33/21 R |
| 3,664,030 | 5/1972 | Pope, Jr. | 33/21 R |
| 4,345,379 | 8/1982 | Pettingill, Jr. | 33/21 R |

FOREIGN PATENT DOCUMENTS

| | | | |
|---|---|---|---|
| 948465 | 8/1956 | Fed. Rep. of Germany | 33/21 R |

*Primary Examiner*—Richard R. Stearns
*Attorney, Agent, or Firm*—Bacon & Thomas

[57] ABSTRACT

A precision scribing tool for scribing a circumferential line around a tubular workpiece at a precise distance from the end of the workpiece includes an annular socket with a shoulder defining the bottom of the socket for receiving the end of a tubular workpiece to be socket welded, and a scriber assembly attached to the socket. The scriber assembly includes a hardened point that can be pressed against the surface of the tubular workpiece while the annular socket is manually rotated around the tube end. The scribing device includes a spring biased plunger mechanism that assures accuracy for scribing a line around the tube at a precise distance from the longest point on the end of the tube to permit inspection of a welded joint between the tube end and a socket element to insure that the tube end is located a precise distance within the socket.

4 Claims, 2 Drawing Figures

PRECISION SCRIBER FOR TUBULAR WORKPIECES

BACKGROUND OF THE INVENTION

This invention relates to a hand tool for precisely scribing a circumferential line around a tubular workpiece at a precise distance from the end of the workpiece.

The invention finds particular application for scribing a circumferential line about a pipe tubular element that is to be socket welded for the purpose of permitting inspection of the socket weld after the welding operation has been completed.

A socket weld is a welded joint between coaxial tubular workpieces, and specifically between a smaller tube disposed within a larger tube having a female socket within which the end of the smaller tube fits. In preparation for welding operation, the smaller tube is inserted within the socket of the larger tube end until the end of the smaller tube abuts the bottom of the socket. The smaller tube is then withdrawn a small distance and the welding is carried out between the free end of the larger tube socket and the outer sidewall of the smaller tube. It is critically important that the end of the smaller tube be spaced from the bottom of the socket of the larger tube, otherwise expansion forces could ultimately result in a defective weld when the workpieces expand or contract after the welding operation. It will be appreciated that it is important to maintain a small gap between the end of the smaller tube and the bottom of the socket to permit normal expansion and contraction of the free end of the smaller tube disposed within the socket. If this gap is not provided at the time of performing the weld, the resultant joint is considered to be defective and will not pass a subsequent inspection if the inspector can determine that this gap has not been provided.

The problem in the prior art has been that it is virtually impossible for an inspector to precisely determine whether or not a suitable gap has been maintained between the end of the smaller tube and the bottom of the socket of the larger tube during the welding operation, since there is no normal reference point on the outside of the smaller tube that would enable him to gauge the maximum distance remaining to the longest point on the smaller tube. The problem is compounded when it is realized that the ends of the smaller tubes are not always cut squarely, so that there may be a discontinuous or irregular gap between the end of the smaller tube and the bottom of the socket. Thus, even though a gap might be provided around a portion of the circumference of the end of the smaller tube, the longest portion of the end might actually abut the bottom of the socket, resulting in a defective joint connection.

It has thus been recognized that a device for marking the end of a smaller tube to be inserted into the socket of a larger tube end in a precise manner to provide an inspector of a weld joint with a visual means for determining the precise distance between the observable mark on the smaller tube and the maximum length of the tube is highly desirable. However, prior art devices for accomplishing such marking are not readily available for use in an environment where tube welding operations are being carried out. Such a marking device would need to be extremely rugged while yet able to perform a precise scribing operation for providing a permanent visual mark about the circumference of a tube at a precise distance from its longest dimension.

Such a device would need to be relatively simple and inexpensive to manufacture since, above all, would need to be a simple hand tool readily usable by welders or helpers. The tool, moreover, would need to be readily serviceable in the field if the need should arise.

The present invention has been made with all these considerations in mind to fulfill the above objectives.

SUMMARY OF THE INVENTION

The present invention is a hand held, precision scriber for permanently marking the end areas of tubular workpieces to be socket welded to provide a visual indication to an inspector of a socket welded joint respecting the precise distance between the scribed mark and the longest dimension of the tubular workpiece.

More specifically the scribing tool comprises a precisely dimensioned annular socket body having an abutment located within the socket at one end thereof and a scribing element located a precise distance away from the abutment in the sidewall of the socket body.

Thus, a tubular workpiece can be inserted into the cavity of the socket body until its longest dimension strikes the abutment, and then the scribing element can be rotated around the periphery while the end of the tubular workpiece rests against the abutment.

The scriber implement is ruggedly constructed and the scribing element itself is assembled in a precise fashion so that it will remain accurate throughout its operational life. This is achieved by making the scriber assembly in the form of a radially reciprocable plunger element that includes a cylindrical shank that rides within a cylindrical opening extending through the sidewall of the annular socket body. The scribing element, moreover, it is biased by a spring element so that it normally is retracted out of the cavity area of the socket body. During operation, after the tube end is inserted into the socket body until it extends up to the abutment, the operator simply presses his thumb or forefinger against the plunger shaft of the scribing element to cause the same to bear against the outer periphery of a tube while twisting the socket body around the circumference of the tube with the end of the tube in constant contact with the abutment of the socket body.

This results in a circumferential line that is permanently scratched into the surface of the tube at a precise distance from the longest dimension of the tube to provide an inspector with a visual indication that a socket weld has been properly executed.

The invention will become more apparent from a review of the appended drawings and the detailed description set forth below.

DETAILED DESCRIPTION OF THE INVENTION

Figure 1:
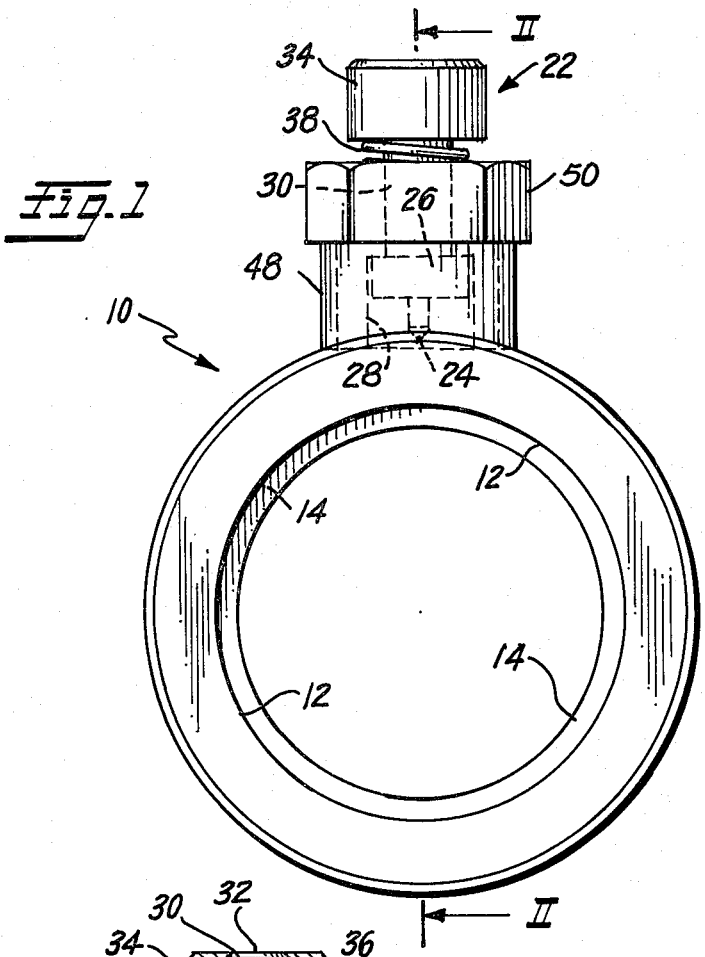
FIG. 1 is an end view of the precision scriber constructed in accordance with the present invention.
Figure 2:
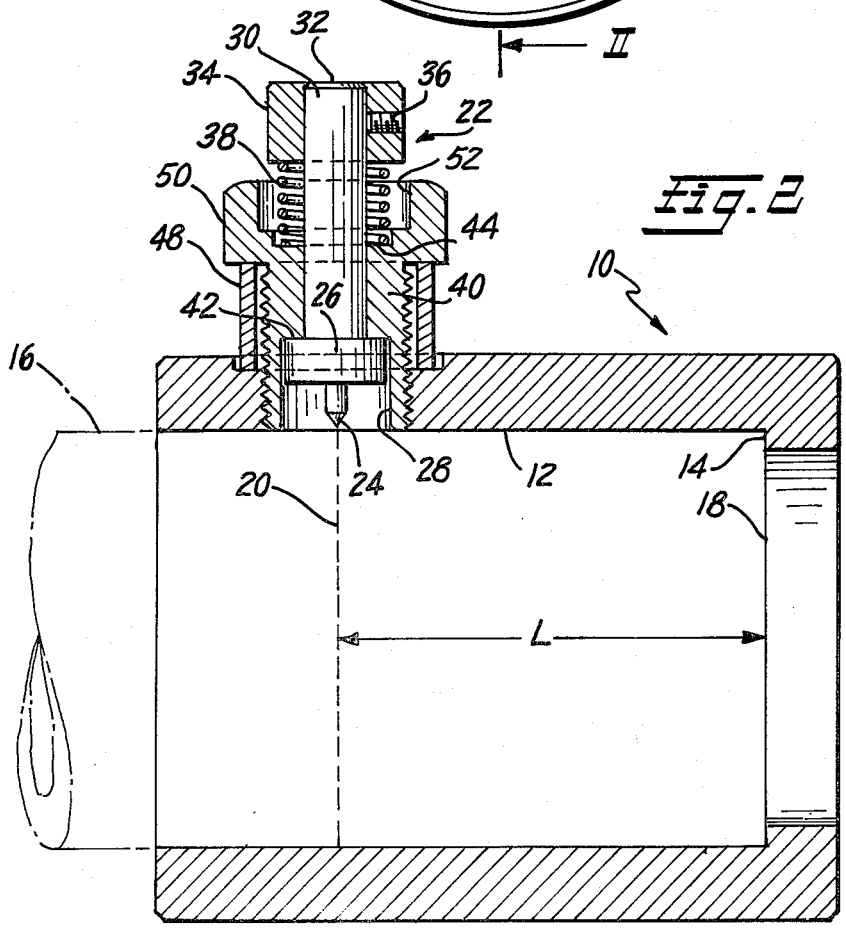
FIG. 2 is a sectional side elevation view taken along line II—II of FIG. 1.

With reference to the drawings, a hand tool is illustrated for scribing a visible mark in the surface of a tubular workpiece at a precise distance from the maximum lengthwise dimension of the end of the tube. The tool comprises an annular socket body 10 preferably formed from solid metal, such as stainless steel. The socket body 10 has an interior cavity defined by an interior sidewall 12 that terminates at a continuous shoulder 14 that provides an abutment within the cavity of the socket body. The dimensions of the inner sidewall 12 and the shoulder 14 are precisely formed to receive the end of a tubular workpiece 16 shown in hidden lines in FIG. 2 for clarity. Thus, insertion of the end of the tubular workpiece 16 into the cavity of the socket body 10 until the end 18 rests against the shoulder abutment 14 will permit the operator to locate a scribe mark 20 a precise distance L from the end 18 of the workpiece.

The scribe mark 20 is placed on the circumference of the tube workpiece 16 by scratching the surface with a hardened point of a scriber that is carried by the socket body 10. Such scriber constitutes part of the scriber assembly 22 to be described below in more detail.

The scriber assembly 22 includes a hardened steel point 24 that is secured rigidly (e.g., by an interference fit within a socket) to a cylindrical shank portion 26 that closely fits within a cylindrical opening 28, yet is free to reciprocate in a radial direction relative to the socket 10 within the cylindrical opening.

The cylindrical shank 26 is connected to a plunger shaft 30 that terminates at its distal end 32 some distance away from the socket body 10. An enlargement 34 is attached to the end 32 of the plunger shaft 30 by a fastener 36 or in the alternative, the end of the plunger shaft 32 may be provided with any means at its end thereof for enabling application of manual pressure thereto in a comfortable manner.

The plunger shaft 30 is held in retracted position out of the interior of the cavity within the socket body 10 by means of a compression spring 38 disposed under the enlarged end 34 of shaft 32.

The cylindrical shank 26 and plunger shaft 30 extend through a generally annular opening within a bolt 40 that is threadedly received within an aperture that extends radially through the sidewall of the socket body 10 at a precise distance from the shoulder abutment 14 within the socket body. The bolt 40 includes an interior configuration that provides a stop shoulder 42 for limiting retraction motion of the shank 26 and includes another shoulder 44 against which spring 38 abuts at its lower end.

A spacer washer 48 is provided to limit inward movement of bolt 40 towards the interior of the cavity within the socket 10 by abutting the outside wall of the socket member 10 and the underside of the bolt head 50.

Alternatively, the spacer 48 could be integral with the bolt 40 and simply constitute a shoulder on the bolt itself beneath the bolt head 50. While it is preferred that a simple bolt be used to support the scriber shank and plunger element, since this is a relatively simple construction and readily serviceable in the field, any suitable interconnection between the sidewall of the socket body 10 and the scriber shank 26 could be utilized, so long as the shank 26 was precisely guided for radial movement relative to the cavity of the socket body 10. Such a connection would need to precisely locate the point 24 at a predetermined accurate distance from the shoulder abutment 14 and be sufficiently rugged so that the precision of the scribing operation would not deteriorate after prolonged use of the tool.

In operation, the tube 16 is inserted into the cavity of the socket body 10 until the end of the tube abuts against the shoulder 14. It will be readily apparent that, even if the end of the tube 16 is not precisely cut squarely with the longitudinal axis of the tube, the longest dimension of the tube end will determine where the scribed line 20 is located when the shoulder 14 is a continuous radial shoulder surface, such as is illustrated.

To provide the scribe mark 20 on the surface of the workpiece 16, the operator grasps the socket body 10 and rotates the same around the end of the tube 16 while pressing down on the plunger shaft 30 to force the point 24 into engagement with the surface of the tube 16.

In the preferred embodiment, the head 50 of the bolt 40 is provided with an annular undercut 52 that permits the enlarged end 34 of the plunger shaft 32 to be received within the bolt head envelope area. This provides a compact, rugged design suitable for the environment where welding operations are carried out. Without this feature, the enlarged end 34 of the plunger shaft 30 would need to be cantilevered at a further distance from the top of the bolt head 50.

It is thus readily observable that a rugged yet simple hand tool for inscribing a visible mark on the circumference of a tube end at a precise difference from its longest dimension is provided. The tool is readily serviceable because the scribing assembly can be quickly dismantled and repaired if necessary without requiring the use of specialized tools. The scribing elements are extremely rugged and not sensitive to abuse or improper operating procedures.

Alternate constructural details can be envisioned by anyone skilled in the art without departing from the scope of the invention, which is defined below in the claims.

I claim:

1. A precision scriber for permanently marking the circumference of a tube end area at a precise distance from the end of such tube, comprising:

an annular socket body having an inner cylindrical wall and an end abutment projecting inwardly of the inner circumference of the cylindrical wall at one end area thereof, and being open for axially receiving a tube to be inscribed at the opposite end thereof, the socket body further including a radial aperture extending through said cylindrical wall at a predetermined precise distance from said abutment;

a precision scriber assembly mounted on said socket body at the location of said radial aperture;

said scriber assembly including a radially reciprocable scriber element including a hardened metal point connected to a cylindrical shank portion;

a plunger shaft connected to the shank portion, the plunger shaft extending outwardly of the socket body for manipulation during operation;

a close-fitting, radially extending cylindrical guide for said shank portion, said guide located at a predetermined precise distance from said abutment;

means for biasing said plunger shaft in a direction tending to withdraw the point from the interior of the socket body, the shank portion being radially movable against the spring bias to a sufficient extent to permit the point to project into the socket body interior; and said aperture being threaded and said cylindrical guide comprising an externally threaded annular bolt having a lower portion including an interior cylindrical opening along its length and a higher portion including an axial opening; said cylindrical opening constituting said cylindrical guide; said plunger shaft extending through said axial opening.

2. A scriber as claimed in claim 1, said plunger shaft extending generally coaxially with said cylindrical plunger and terminating at an enlarged end area; said bolt having an enlarged annular head and an internal undercut shoulder within said bolt head, said spring biasing means comprising a compression spring disposed within said bolt extending along said plunger shaft in coaxial relationship therewith between said shoulder and the enlarged end of the plunger shaft; said enlarged end of said plunger shaft disposed radially outwardly of said bolt head with respect to said socket body.

3. A scriber as claimed in claim 2, said undercut area including a portion for receiving at least a portion of said enlarged end of said plunger shaft when said enlarged end is depressed against the bias of the spring in a direction towards the interior of said socket body.

4. A scriber as claimed in claim 3, wherein said abutment within said socket body is a continuous radial shoulder.

* * * * *